US005374205A

United States Patent [19]

Ohashi

[11] Patent Number: 5,374,205

[45] Date of Patent: Dec. 20, 1994

[54] FUSE HOLDER

[75] Inventor: Kozi Ohashi, Saitama, Japan

[73] Assignee: Kyoshin Kogyo Co. Ltd., Japan

[21] Appl. No.: 49,574

[22] Filed: Apr. 19, 1993

[30] Foreign Application Priority Data

Apr. 20, 1992 [JP] Japan ..... 4-032729[U]

[51] Int. Cl.[5] ..... H01R 4/48

[52] U.S. Cl. ..... 439/831; 439/830

[58] Field of Search ..... 439/830–833

[56] References Cited

U.S. PATENT DOCUMENTS 1,204,691 11/1916 Sachs ..... 439/830
1,267,457 5/1918 Sachs ..... 439/830
1,327,844 1/1920 Schaefer ..... 439/830
2,740,735 4/1956 Swain ..... 439/830
3,171,002 2/1965 Kinnear ..... 439/830 X
4,052,688 10/1977 DeNigris et al. ..... 439/830 X

*Primary Examiner*—Eugene F. Desmond
*Attorney, Agent, or Firm*—Pearne, Gordon, McCoy & Granger

[57] ABSTRACT

A fuse bolder used to be mounted on a circuit board for holding a cartridge fuse and comprising a pair of clips each having a stop provided integrally on their clip bodies at an upper end thereof so that the cartridge fuse, when it is inserted into the fuse holder while it is axially biased, is restrained from being inserted thereinto because it strikes the stop of the corresponding clip body.

2 Claims, 3 Drawing Sheets

FUSE HOLDER

BACKGROUND OF THE INVENTION

This invention relates to a fuse holder used to be mounted on a circuit board and more particularly an improvement on a fuse holder used for physically holding a cartridge fuse while the latter is electrically connected to the former.

In general, such a fuse holder comprises a pair of fuse holding clips 16 and 16', as shown in FIG. 6. Each of the fuse holding dips 16 and 16' comprises a U-shaped clip body including a base receiving opening 18 to receive one of bases of a cartridge fuse 12 into the clip body therethrough, a narrowed holding portion 20 defined by a pair of curved pieces 20A and 20B to resiliently hold the cartridge fuse 12 thereon and a stop 22 provided on the clip body 17 and serving to restrain the cartridge fuse 12 from being axially removed out of the fuse holder.

In the conventional fuse holder, the stop 22 is provided on the narrowed holding portion 20 at its lower end as shown in FIG. 6 so that the cartridge fuse 12 is never axially removed out of the fuse holder.

In this fuse holder, when the cartridge fuse 12 is inserted through the base receiving openings 18 into and between a pair of fuse holding clips 16 and 16' while it is axially biased relative to the pair of the fuse holding clips 16 and 16' so as to engage one of the stops of the fuse holding clips, the cartridge fuse 12 will be inserted into the fuse holder while it expands the curved pieces 20A and 20B through the stop 22 as shown in FIG. 7.

It will be understood that this causes the cartridge fuse 12 to be incompletely held on the fuse holder because one of the bases of the fuse 12 will engage both of the curved pieces 20A and 20B, but the other base of the fuse 12 will engage only one of the curved pieces 20A and 20B due to interposition of the corresponding stop 22.

SUMMARY OF THE INVENTION

Accordingly, it is a principal object of the invention to provide a fuse holder adapted to prevent a cartridge fuse from being inserted into the fuse holder while it is axially biased relative to a pair of fuse holding clips.

In accordance with the present invention, there is provided a fuse holder comprising a pair of fuse holding clips each comprising a generally U-shaped clip body including a base receiving opening to receive one of bases of a cartridge fuse into said clip body therethrough, a narrowed holding portion defined by a pair of curved pieces to resiliently hold said cartridge fuse thereon and a stop provided on said clip body and serving to restrain said cartridge fuse from being axially removed out of said fuse holder, characterized by that said stop is provided at an upper edge of said clip body adjacent to said base receiving opening.

With the stop provided at the upper edge of the clip body, the cartridge fuse, which an operator tries to insert while it is axially biased relative to the fuse holder cannot be inserted into the fuse holding clip because the stop catches the cartridge fuse and serves to restrain the fuse from being introduced into the clip body. It will be noted that this prevents the cartridge fuse from being inserted into the fuse holder in an incorrect manner while it is axially biased relative to the fuse holder.

BRIEF DESCRIPTION OF THE DRAWINGS

The above and other objects and features of the invention will be apparent from the description of the embodiment of the invention taken along with the accompanying drawings in which.

DETAILED DESCRIPTION OF THE EMBODIMENT

Figure 1:
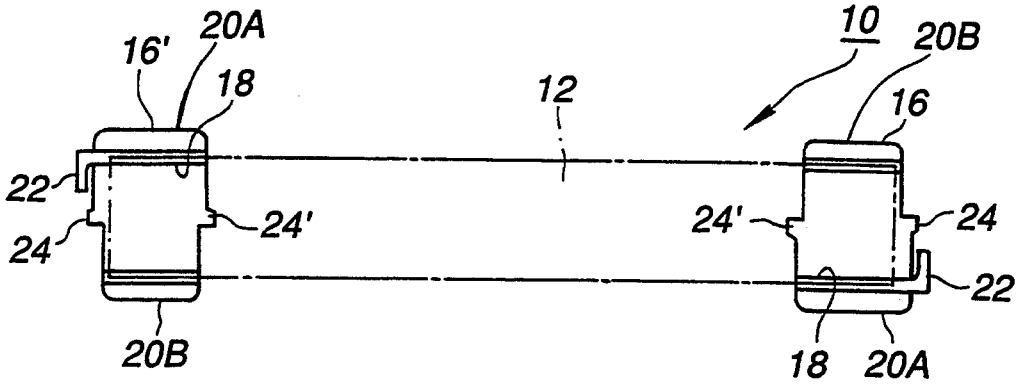
FIG. 1 is an upper view of a fuse holder constructed in accordance with the invention.
Figure 2:
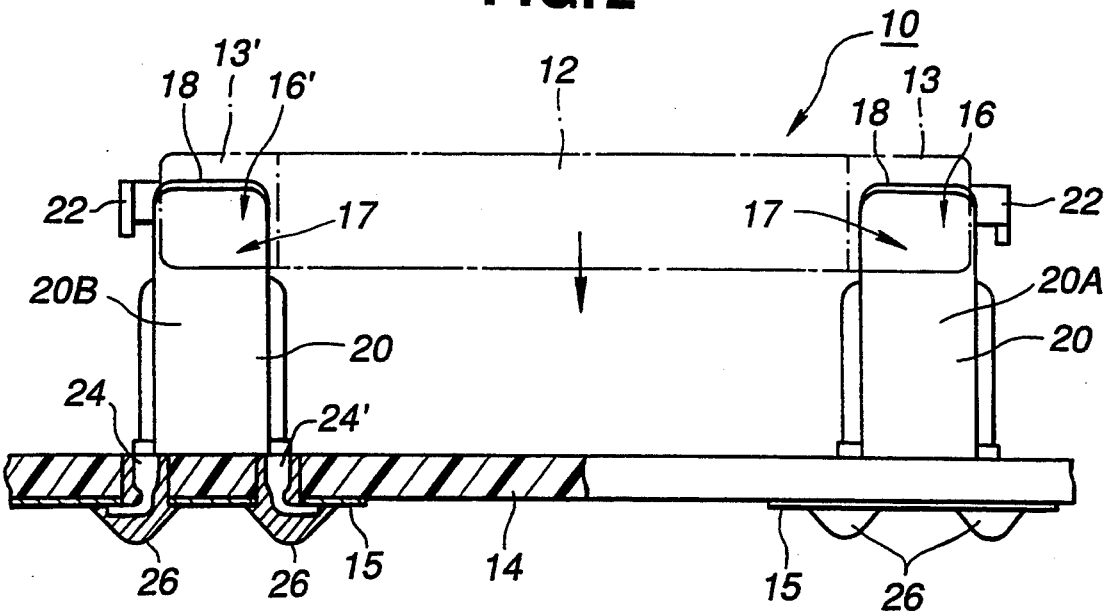
FIG. 2 is a side elevational view of the fuse holder of FIG. 1 with a portion thereof broken.

Referring now to FIGS. 1 and 2, there is shown a fuse holder 10 comprising a pair of fuse holding clips 16 and 16' mounted on a circuit board 14 such as a printed circuit board in a spaced manner so that both of bases of a cartridge fuse 12 are held by the corresponding fuse holding clips 16 and 16', respectively.

Figure 4:
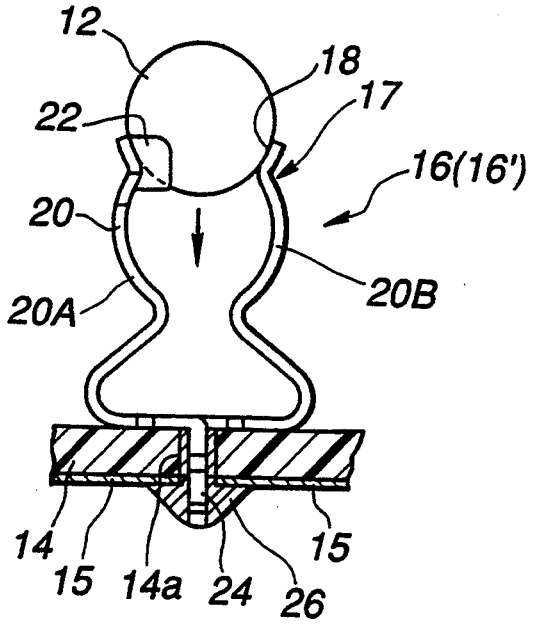
FIG. 4 is an enlarged front view of the fuse holder of FIG. 1 with a mounting portion illustrated in cross sectional view

As shown in FIGS. 2 and 4, each of the fuse holding clips 16 and 16' comprises a generally U-shaped clip body 17 including a base receiving opening 18 to receive bases 13 and 13' of the cartridge fuse 12 into the corresponding fuse holding clips 16 and 16' therethrough, a narrowed holding portion 20 defined by a pair of curved pieces 20A and 20B to resiliently hold the cartridge fuse 12 thereon and a stop 22 provided on the clip body 17 so as to restrain the cartridge fuse 12 from being axially removed out of the fuse holder 10.

The fuse holding clips 16 and 16' may be formed by punching and stamping metal strip of copper, aluminium, alloys thereof or the like.

As shown in FIGS. 1 through 4, the clip body 17 further includes a pair of mounting legs 24 and 24' provided integrally on the clip body 17 at the bottom thereof. The mounting legs 24 and 24' extend through mounting holes **14*a* in the circuit board 14, are clinched along the back face of the circuit board 14 and electrically connected by a soldering layer 26 to an electrically conductive layer 15 which may be of copper foil provided on the circuit board 14, for example and physically held onto the circuit board 14. Of course, the electrically conductive layer 15** may be formed of metal material such as copper alloy, aluminium or aluminum alloy or the like other than copper.

As noted from FIG. 1, the pair of fuse holding clips 16 and 16' are so disposed that the stops 22 thereof are positioned outside of the clip bodies 17 in an opposite and symmetrical manner.

As shown in FIGS. 2 and 4, the stops 22 of the fuse holding clips 16 and 16' are essentially provided integrally on the clip bodies 17 at their upper end thereof so that the stops 22 obstruct the corresponding bases 13 and 13' of the cartridge fuse 12, which is axially biased relative to the fuse holder 10. The stops are preferably positioned at upper edges of the corresponding base receiving openings 18. As shown in FIGS. 1 and 2, it will be noted that the stops 22 are formed of pieces integrally extending from the wall defining the base receiving opening 18 and corresponding to the curved piece 20A of the holding portion 20.

Figure 5:
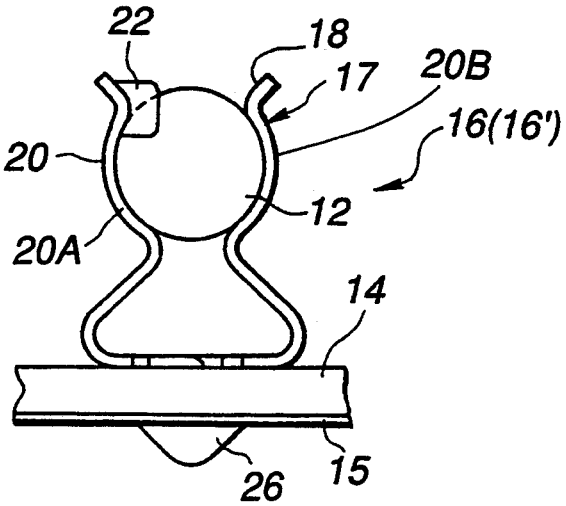
FIG. 5 is an enlarged front view of the fuse holder of FIG. 1 with the cartridge fuse inserted thereinto.
Figure 6:
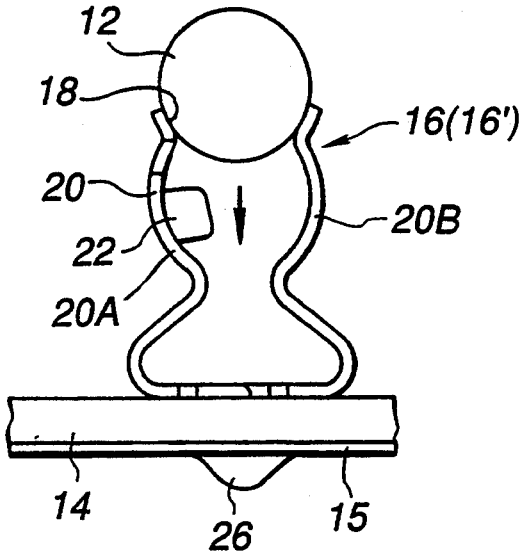
FIG.6 (PRIOR ART)
FIG. 6 is an enlarged front view of a fuse holder constructed in accordance with a prior art.
Figure 7:
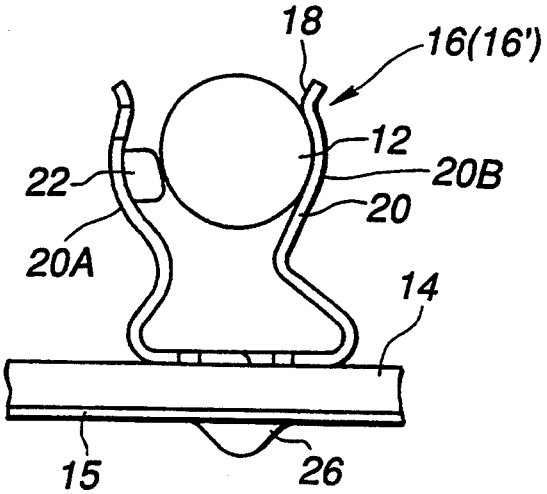
FIG.7 (PRIOR ART)
FIG. 7 is an enlarged front view of the fuse holder of FIG. 6 with a cartridge fuse incompletely inserted thereinto.

As noted from FIGS. 2 and 5, the stops 22 of the fuse holding clips 16 and 16' are disposed while they have such a dimension as they are adapted to engage the bases 13 and 13' of the cartridge fuse 12.

Figure 3:
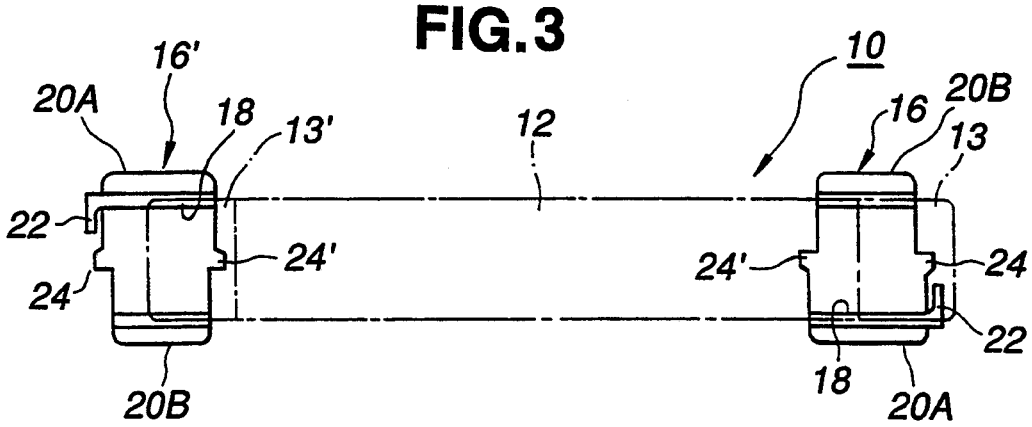
FIG. 3 illustrates in an upper view a cartridge fuse which an operator tries to insert into the fuse holder while it is axially biased relative to the fuse holder.

With the stops 22 provided at the upper end of the clip bodies 17 of the fuse holding clips 16 and 16' so that they are positioned at the upper edges of the base receiving openings 18, when an operator tries to insert the cartridge fuse 12 into the fuse holding clips 16 and 16' while it is axially biased relative to the fuse holder 10, the fuse 12 cannot be inserted into the fuse holder 10 because the cartridge fuse 12 strikes either of the stops 22, which causes the fuse to be restrained from being introduced into the corresponding fuse holding clip 16 or 16' as shown in FIG. 3. It will be noted that this prevents the cartridge fuse 12 from being inserted into the fuse holder 10 in an incorrect manner while it is axially biased relative to the fuse holder 10. Thus, the cartridge fuse 12 can be held by the fuse holder 10 only in a correct position thereof. This can positively prevent the cartridge fuse 12 from engaging only one of the curved pieces 20A and 20B and therefore from engaging the fuse holding clips 16 and 16' without any good electrical contact thereto.

Although a single embodiment of the invention has been described and illustrated with reference to the accompanying drawings, it will be understood by those skilled in the art that it is by way of example, and that various changes and modifications may be made without departing from the spirit and scope of the invention, which is defined only to the appended claims.

What is claimed is:

1. A fuse holder comprising a pair of fuse holding clips each comprising a generally U-shaped clip body including a wall forming a base receiving opening to receive one of the bases of a cartridge fuse into said clip body therethrough, a holding portion defined by a pair of curved pieces to resiliently hold said cartridge fuse thereon and a stop provided on said clip body and serving to restrain said cartridge fuse from being axially removed out of said fuse holder, characterized by further comprising means to prevent said cartridge fuse from being inserted into said pair of fuse holding clips when said cartridge fuse is axially biased relative to said pair of fuse holding clips said means to prevent said cartridge fuse from being inserted into said pair of fuse holding clips comprising said stop provided by a wall extension at an upper edge extremity of said wall of said base receiving opening of said clip body, said wall extension including a first portion extending axially to a second portion extending angularly to a location axially offset from said holding portion of said clip body, said wall extension having a wall surface facing the holding portion and an edge surface facing away from the holding portion so that said cartridge fuse strikes said edge surface before said curved pieces are spread by said cartridge fuse and the reaction forces are parallel to the plane of the wall extension.

2. A fuse holding clip used for a fuse holder comprising a generally U-shaped clip body including a wall forming a base receiving opening to receive one of the bases of a cartridge fuse into said clip body therethrough, a holding portion defined by a pair of curved pieces to resiliently hold said cartridge fuse thereon and a stop provided on said clip body and serving to restrain said cartridge fuse from being axially removed out of said fuse holder, characterized by further comprising means to prevent said cartridge fuse from being inserted into said pair of fuse holding clips when said cartridge fuse is axially biased relative to said pair of fuse holding clips; said means to prevent said cartridge fuse from being inserted into said pair of fuse holding clips comprising said stop provided by a wall extension at an upper edge extremity of said wall of said base receiving opening of said clip body, said wall extension including a first portion extending axially to a second portion extending angularly to a location axially offset from holding portion of said clip body, said wall extension having a wall surface facing the holding portion and an edge surface facing away from the holding portion so that said cartridge fuse strikes said edge surface before said curved pieces are Spread by said cartridge fuse and the reaction forces are parallel to the plane of the wall extension.

* * * * *